US005545794A

United States Patent [19]

Bray

[11] Patent Number: 5,545,794

[45] Date of Patent: Aug. 13, 1996

[54] METHOD FOR DECONTAMINATION OF RADIOACTIVE METAL SURFACES

[75] Inventor: Lane A. Bray, Richland, Wash.

[73] Assignee: Battelle Memorial Institute, Richland, Wash.

[21] Appl. No.: 492,181

[22] Filed: Jun. 19, 1995

[51] Int. Cl.[6] ..... G21F 9/00

[52] U.S. Cl. ..... 588/1; 134/3; 134/22.15; 134/30; 134/41; 976/DIG. 376

[58] Field of Search ..... 588/1; 134/3, 2, 134/22.12, 22.15, 22.18, 30, 28, 41; 976/DIG. 376

[56] References Cited

U.S. PATENT DOCUMENTS 4,162,229 7/1979 Loewenschuss ..... 252/301.1
4,581,074 4/1986 Mankina et al. ..... 134/2
4,663,085 5/1987 Enda et al. ..... 252/626
4,685,971 8/1987 Murray et al. ..... 134/2
4,880,559 11/1989 Murray et al. ..... 252/186.21
4,902,351 2/1990 Kunze et al. ..... 134/3

*Primary Examiner*—Ngoclan Mai
*Attorney, Agent, or Firm*—Douglas E. McKinley, Jr.

[57] ABSTRACT

Disclosed is a method for removing radioactive contaminants from metal surfaces by applying steam containing an inorganic acid and cerium IV. Cerium IV is applied to contaminated metal surfaces by introducing cerium IV in solution into a steam spray directed at contaminated metal surfaces. Cerium IV solution is converted to an essentially atomized or vapor phase by the steam.

17 Claims, No Drawings

METHOD FOR DECONTAMINATION OF RADIOACTIVE METAL SURFACES

This invention was made with Government support under Contract DE-AC06-76RLO 1830 awarded by the U.S. Department of Energy. The Government has certain rights in the invention.

FIELD OF THE INVENTION

The present invention relates generally to a method for removing radioactive contaminants from metal surfaces by applying steam containing an inorganic acid and cerium IV.

BACKGROUND OF THE INVENTION

The advantages and use of cerium IV in an aqueous solution for the decontamination and removal of radioactive contaminants from metal surfaces are well known in the art. U.S. Pat. No. 4,162,229 discloses the use of cerium IV salts in aqueous solutions for decontaminating the metal surfaces of nuclear reactors. U.S. Pat. No. 4,880,559 discloses ceric acid in solution with an inorganic acid. In each of these disclosures, a cerium-containing solution is applied to metal parts which have been contaminated through the formation of radioactive elements at or near the surface. The reaction of cerium with the radioactive deposits renders the deposits soluble, allowing them to be removed from the contaminated metal. The cerium is maintained in a liquid phase, or in solution, either through the application of pressure or by maintaining the solution's temperature below its boiling point.

While many methods utilizing cerium-containing solutions for removing radioactive elements from metals have been found, there remains a need for improved methods of decontamination. New methods are sought which perform cleanup more quickly and allow the decontamination of certain contaminated surfaces which, due to their orientation in space, are difficult to reach with decontamination materials, or which generate less waste volume.

SUMMARY OF THE INVENTION

In the present invention, cerium IV is applied to contaminated metal surfaces by introducing cerium IV in solution into a steam spray directed at the contaminated metal surfaces. The cerium IV solution is converted to an essentially atomized or vapor phase by the steam. It is also carried along with the steam such that the cerium IV may be directed at a contaminated metal surface which is to be decontaminated. Upon contact with a contaminated metal surface, the cerium IV condenses or clings to the contaminated metal surface, and then reacts with radioactive contaminants on the surface to render the contaminants soluble in water.

The present invention thus makes use of the discovery of the surprising result that despite the combination of air within the steam spray, the projection of the steam through air, the elevated temperatures of the steam, and the partial or complete vaporization or atomization of the cerium IV solution, the cerium will remain in a plus four oxidation state for a sufficient period of time to solubilize radioactive contaminants on the contaminated metal surfaces. In other words, the solubilization of radioactive contaminants occurs before the cerium IV is reduced to cerium III. In practice, the solubilization of the radioactive contaminants is essentially instantaneous upon contact with the cerium IV. This permits effective decontamination of contaminated metal surfaces with the application of a much smaller quantity of cerium IV and solute than is required by the methods presently known and used in the art. The introduction of cerium IV to the steam spray and subsequent conversion of the cerium IV to an essentially atomized or vapor phase allows another advantageous feature of the invention. In an essentially atomized or vapor phase, the cerium IV may be directed towards contaminated metal surfaces which, due to their orientation in space, are not readily or conveniently treated with solutions presently used in the art. For example, it may be difficult or dangerous to apply very hot cerium IV-containing solutions to contaminated metal surfaces which are vertical or past vertical because gravity will tend to pull the solution away from the contaminated metal surface. The present invention allows application of the cerium IV to a contaminated metal surface regardless of the orientation of the contaminated metal surface in space because the cerium IV is transported to the contaminated metal surface in an essentially atomized or vapor phase. By providing cerium III in a steam spray, the required volume for effective decontamination is small enough to permit the required volume of cerium IV to cling to a contaminated metal surface which is vertical or past vertical. Thus, the present invention significantly reduces the quantity of spent decontamination solution, allows effective decontamination of surfaces regardless of their orientation in space, and reduces the attendant cleanup or regeneration costs.

The subject matter of the present invention is particularly pointed out and distinctly claimed in the concluding portion of this specification. However, both the organization and method of operation, together with further advantages and objects thereof, may best be understood by reference to the following description.

DESCRIPTION OF THE PREFERRED EMBODIMENT(S)

In a first preferred embodiment, a stream of steam is directed through air towards a contaminated metal surface which is to be decontaminated. The solubilization of radioactive contaminants proceeds more rapidly at elevated temperatures; therefore, it is preferred that the stream be applied to the contaminated metal surface for a sufficient period of time to increase the temperature of the contaminated metal surface to a temperature of approximately 90° C., preferably to a temperature of about 100° C. The steam itself is preferentially heated to a temperature between about 110° and about 165° C., and pressurized to between about 10 and about 90 psi preferably between about 10 and about 70 psi. When the contaminated metal surface is sufficiently heated, an aqueous solution of nitric acid and cerium IV is pumped directly into the stream and is thereby carried within the stream whereupon it is applied to the contaminated metal surface. Heat from the steam stream is imparted to the solution, thus it is not necessary to heat the solution prior to its introduction to the stream. Upon contact of the solution-bearing stream with the contaminated metal surface, solubilization of contaminants within the contaminated metal surface is essentially instantaneous. Once solubilized, contaminants are easily removed from the now decontaminated metal surface, by way of example, by washing the part with liquid water.

The concentrations of nitric acid and cerium IV, which are useful for decontamination, are well known in the art; nitric acid may range from about 0.1M to about 5M, and cerium IV may range from about 0.01M to about 1M. It will be apparent to one skilled in the art of decontamination that the flow rate and concentration of the aqueous solution of cerium IV and nitric acid, as well as the flow rate of the steam stream, will affect the absolute quantity of cerium IV which will ultimately come in contact, and thereby decontaminate, contaminated metal surfaces. Thus, by increasing either the flow rate or the concentration of the aqueous solution, a contaminated metal surface is exposed more rapidly to a given quantity of cerium IV and nitric acid. Similarly, adjusting the steam stream's flow rate can increase or decrease both the dilution and rate at which the aqueous solution is carried to the contaminated surface. However, it is preferable to expose the contaminated metal surface to only as much nitric acid and cerium IV as is necessary for decontamination, since once decontamination is complete, additional nitric acid and cerium IV simply add to the volume of spent decontamination solution which must be cleaned up or otherwise disposed. Thus, for the present invention, the solution preferably comprises about 2M nitric acid and about 0.5M cerium IV, and is introduced to the steam stream preferably at a rate of approximately 0.5 L/min.

In a second preferred embodiment, a stream of steam is injected into a contaminated metal pipe which is to be decontaminated. Again, the solubilization of radioactive contaminants proceeds more rapidly at elevated temperatures. Therefore, it is preferred that the stream be applied to the contaminated metal pipe for a sufficient period of time to increase the temperature of the contaminated metal pipe to approximately 100° C. When the contaminated metal pipe is sufficiently heated, an aqueous solution of nitric acid and cerium IV is introduced into the stream. Again, heat from the steam is imparted to the solution, thus it is not necessary to heat the solution prior to its introduction to the steam. Upon contact of the solution-bearing steam with the contaminated metal pipe, solubilization of contaminants within the contaminated metal pipe is essentially instantaneous. Once solubilized, contaminants are easily removed from the now decontaminated metal pipe, by way of example, by flushing the pipe with liquid water, followed by flushing the pipe with compressed air.

EXAMPLE

The present invention was utilized to decontaminate a transfer mechanism used for transferring radioactive materials from one radioactive work cell to another. Prior to decontamination, a general survey was performed on the transfer mechanism which measured the dose rate delivered by the transfer mechanism at about 50 R/hr at a distance of about 4 to 6 inches. Operators sprayed the transfer mechanism according to the preferred pressures, temperatures and concentrations of the first preferred embodiment from a distance of about four feet in thirty second bursts. After all exposed surfaces of the transfer mechanism had been sprayed, the transfer mechanism was washed with water and again measured for radiation. The decontaminated transfer mechanism then gave a dose rate of about 25 mR/hr at contact.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A method for removing radioactive contaminants from a metal surface comprising:

(a) directing a stream of steam to said surface, (b) introducing a solution of nitric acid and cerium in a plus four oxidation state into said stream, (c) directing said stream and said solution to said surface.

2. The method of claim 1, wherein said steam is provided between 10 and 70 psi.

3. The method of claim 1, wherein said steam is provided between 110° and 165° C.

4. The method of claim 2, wherein said stream of steam is provided between 110° and 165° C.

5. The method of claim 1, wherein said solution is provided at a rate of at least 0.5 liters per minute.

6. The method of claim 2, wherein said solution is provided at a rate of at least 0.5 liters per minute.

7. The method of claim 3, wherein said solution is provided at a rate of at least 0.5 liters per minute.

8. The method of claim 4, wherein said solution is provided at a rate of at least 0.5 liters per minute.

9. A method for removing radioactive contaminants from a metal surface comprising:

(a) directing a stream of steam to said surface, (b) heating said surface with said steam, (c) introducing a solution of nitric acid and cerium in a plus four oxidation state into said stream, (d) directing said stream and said solution to said surface.

10. The method of claim 6, wherein said steam is provided between 10 and 70 psi.

11. The method of claim 6, wherein said steam is provided between 110° and 165° C.

12. The method of claim 7, wherein said stream of steam is provided between 110° and 165° C.

13. The method of claim 6, wherein said solution is provided at a rate of at least 0.5 liters per minute.

14. The method of claim 7, wherein said solution is provided at a rate of at least 0.5 liters per minute.

15. The method of claim 8, wherein said solution is provided at a rate of at least 0.5 liters per minute.

16. The method of claim 9, wherein said solution is provided at a rate of at least 0.5 liters per minute.

17. The method of claim 6, wherein said surface is heated to a temperature of at least 90° C.

* * * * *